US006205941B1

(12) United States Patent
Yu

(10) Patent No.: US 6,205,941 B1
(45) Date of Patent: Mar. 27, 2001

(54) CHAIN STITCH SEWING MACHINE INCLUDING A NEEDLE-THREAD PUSHING MEMBER

(76) Inventor: Ming-Tung Yu, No. 4, Hsiu-Wu St., San-Min Dist., Kaohsiung City (TW)

( * ) Notice: Subject to any disclaimer, the term of this patent is extended or adjusted under 35 U.S.C. 154(b) by 0 days.

(21) Appl. No.: 09/420,398

(22) Filed: Oct. 18, 1999

(51) Int. Cl.[7] ..... D05B 65/00
(52) U.S. Cl. ..... 112/286
(58) Field of Search ..... 112/197, 286, 112/288, 292, 295, 298

(56) References Cited

U.S. PATENT DOCUMENTS

| | | | | |
|---|---|---|---|---|
| 2,251,676 | * | 8/1941 | Gunther | 112/286 X |
| 3,498,243 | * | 3/1970 | Aoyama | 112/286 |
| 3,960,098 | * | 6/1976 | Papajewski et al. | 112/286 |
| 5,044,290 | * | 9/1991 | Sato et al. | 112/286 |
| 5,469,798 | * | 11/1995 | Gauch | 112/298 |
| 5,481,994 | * | 1/1996 | Ku | 112/298 |
| 5,887,535 | | 3/1999 | Yu | 112/298 |
| 6,021,727 | * | 2/2000 | Ku | 112/286 |

* cited by examiner

*Primary Examiner*—Ismael Izaguirre
(74) *Attorney, Agent, or Firm*—Ladas and Parry

(57) ABSTRACT

A sewing machine includes a machine bed, a presser foot and a needle seat. The presser foot and the needle seat are disposed vertically and movably on the machine bed. A row of vertical stitching needles of different lengths are mounted fixedly on the needle seat, and are arranged one behind another. A front one of each adjacent pair of the stitching needles has a lower end, which is located below that of the rear one. A thread pushing device is disposed on the machine bed behind the needle seat, and includes a needle-thread pushing member that can be driven by a power source and that is adapted to move gradually forward and downward between the presser foot and the stitching needles along a curved path so as to be adapted to push suspended needle threads away from the presser foot just before the presser foot moves downward toward a fabric to be stitched on the machine bed.

2 Claims, 8 Drawing Sheets

CHAIN STITCH SEWING MACHINE INCLUDING A NEEDLE-THREAD PUSHING MEMBER

BACKGROUND OF THE INVENTION

1. Field of the Invention

This invention relates to a chain stitch sewing machine, more particularly to a chain stitch sewing machine, which includes a needle-thread pushing member that moves between a presser foot and stitching needles along a curved path.

2. Description of the Related Art

Referring to FIG. 1, a conventional chain stitch sewing machine 1 is shown to include a machine bed 10, a machine frame 11 fixed relative to the machine bed 10, a presser foot 12, a needle seat 13, a thread pushing device 2 and a thread cutting device 6. The presser foot 12 is adapted to press a fabric 14 on a top surface of the machine bed 10. The needle seat 13 is mounted vertically and movably on the machine bed 10, and carries a row of three vertical stitching needles 131, 131', 131" thereon. The middle needle 131' is shorter than the front needle 131, and is longer than the rear needle 131". As such, the lower end of the middle needle 131' is located above that of the front needle 131, and below that of the rear needle 131". The thread pushing device 2 includes two bolts 21, a mounting member 22, a power source 23, a swing arm 24, an upper rotating element 25, a lower rotating element 26, a connecting rod 27 and a needle-thread pushing member 28. The bolts 21 extend respectively through two side slots 221 in the mounting body 22, thereby locking the mounting body 22 on the machine frame 11. The swing arm 24 is mounted rotatably on the mounting body 22, and can be swung by the power source 23. The upper and lower rotating elements 25, 26 are journalled respectively on the mounting body 22 and the swing arm 26. Each of the rotating elements 25, 26 can rotate about a horizontal axis. The connecting rod 27 is fixed to the rotating elements 25, 26. When the power source 23 is driven, the swing arm 24 activates the connecting rod 27 to move the needle-thread pushing member 28 forward from the position shown by the solid lines to that shown by the phantom lines, thereby moving the same between the presser foot 12 and the needles 131, 131', 131" forward along a generally horizontal path. The aforementioned conventional sewing machine 1 suffers from the following drawbacks:

(1) When the thickness of the fabric 14 or the lengths of the needles 131, 131', 131" are changed, it is necessary to adjust the positions of the bolts 21 relative to the slide slots 221 in the mounting body 22. This adjustment is relatively difficult to conduct.

(2) When the needle-thread pushing member 28 is moved to the generally horizontal position shown by the phantom lines, it is spaced apart from the rear needle 131" by a relatively large distance. As such, it is difficult for the pushing member 28 to push a needle thread, which is suspended from the needle 131", away from the presser foot 12 just before the presser foot 12 moves downward toward the fabric 14. As a result, the suspended needle threads may be clamped between the presser foot 12 and the fabric 14. Furthermore, in a case where the pushing member 28 is adjusted to an excessively low position, it may strike the presser foot 12 during forward movement thereof.

SUMMARY OF THE INVENTION

The object of this invention is to provide a chain stitch sewing machine with a needle-thread pushing member that moves between a presser foot and stitching needles along a curved path, thereby pushing suspended needle threads effectively away from the presser foot.

According to this invention, a sewing machine includes a machine bed, a presser foot and a needle seat. The presser foot and the needle seat are disposed vertically and movably on the machine bed. A row of vertical stitching needles of different lengths are mounted fixedly on the needle seat, and are arranged one behind another. A front one of each adjacent pair of the stitching needles has a lower end, which is located below that of the rear one. A thread pushing device is disposed on the machine bed behind the needle seat, and includes a needle-thread pushing member that can be driven by a power source and that is adapted to move gradually forward and downward between the presser foot and the stitching needles along a curved path so as to be adapted to push suspended needle threads away from the presser foot just before the presser foot moves downward toward a fabric to be stitched on the machine bed.

Preferably, a linkage is disposed between the power source and the needle-thread pushing member, and includes a driving crank, a follower crank and an inclined coupler. The driving crank and the follower crank are mounted rotatably on the machine bed, and are connected pivotally to the coupler. The driving crank can be driven by the power source. The coupler has a lower end that is connected fixedly to the needle-thread pushing member. Accordingly, the power source can drive the linkage to move the needle-thread pushing member along the curved path.

BRIEF DESCRIPTION OF THE DRAWINGS

These and other features and advantages of the invention will become apparent in the following detailed description of a preferred embodiment, with reference to the accompanying drawings, in which.

DETAILED DESCRIPTION OF THE PREFERRED EMBODIMENT

Figure 1:
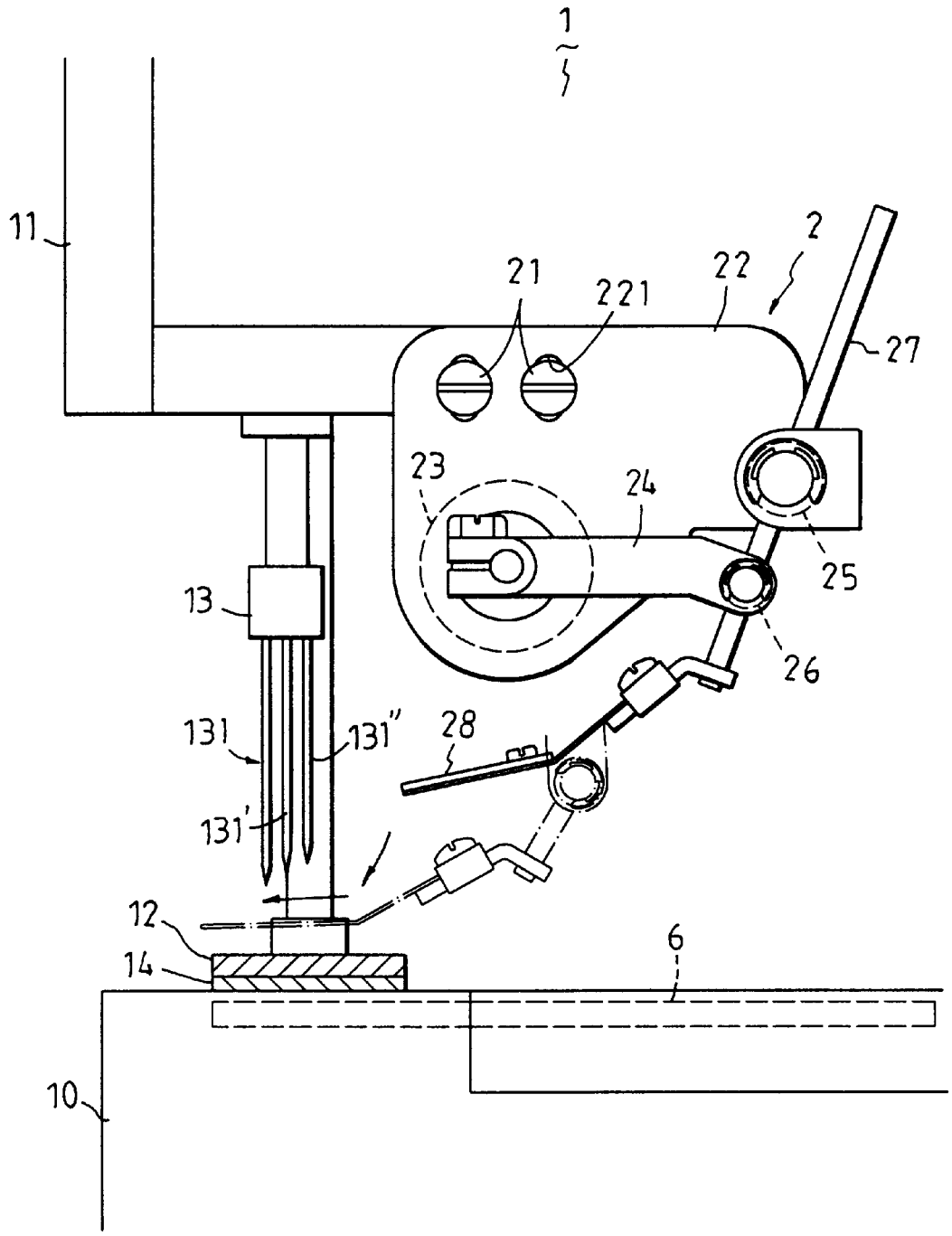
FIG. 1 PRIOR ART
FIG. 1 is a schematic side view illustrating a thread pushing device for a conventional chain stitch sewing machine.
Figure 2:
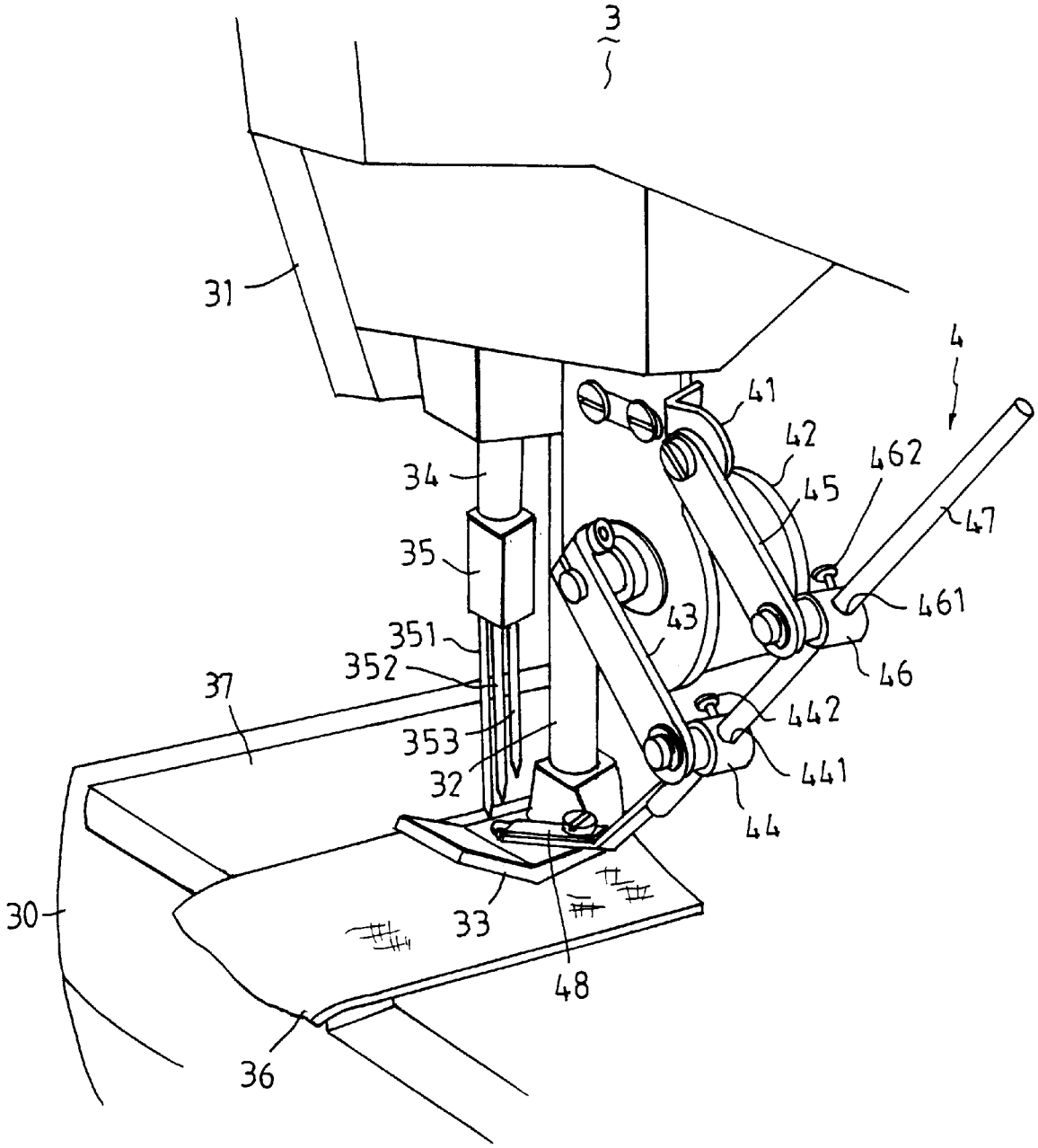
FIG. 2 is a fragmentary perspective view of the preferred embodiment of a chain stitch sewing machine according to this invention.
Figure 3:
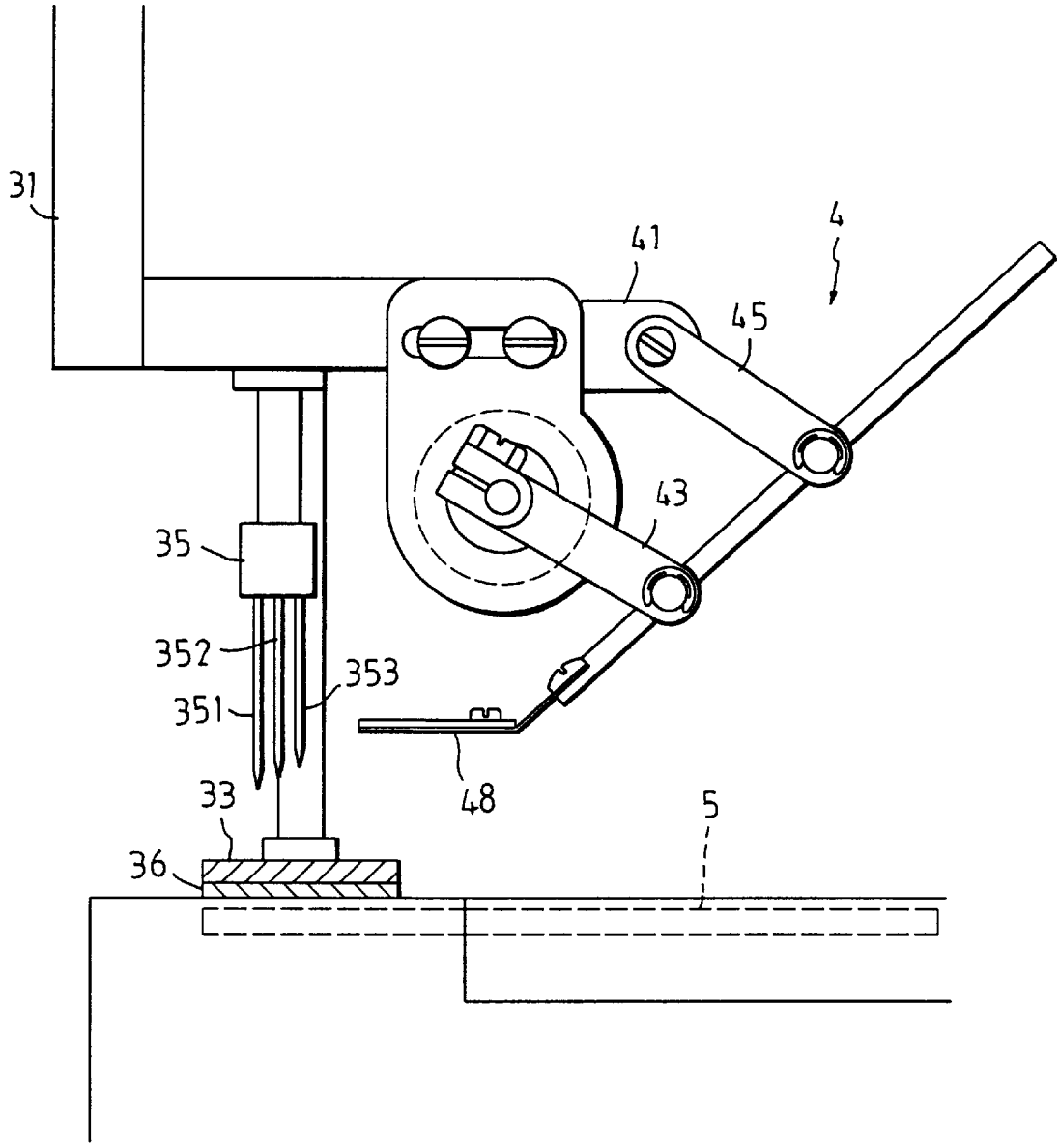
FIG. 3 is a schematic side view illustrating a thread pushing device of the preferred embodiment, in which a needle-thread pushing member is at an upper limit position.

Referring to FIGS. 2 and 3, the preferred embodiment of a chain stitch sewing machine 3 of this invention is shown to include a machine bed 30, a machine frame 31, a first vertical movable rod 32, a presser foot 33, a second vertical movable rod 34, a needle seat 35, a thread pushing device 4, and a thread cutting device 5. The machine frame 31 is fixed relative to the machine bed 30. The first and second vertical movable rods 32, 34 can move vertically on the machine bed 30. The presser foot 33 is carried on the first vertical movable rod 32, and is adapted to press a fabric 36 on a top surface 37 of the machine bed 30. The needle seat 35 is carried on the second vertical movable rod 34, and is provided with a row of vertical stitching needles 351, 352, 353. The middle needle 352 is shorter than the front needle 351, and is longer than the rear needle 352. The lower end of the middle needle 352 is located above that of the front needle 351, and below that of the rear needle 353.

The thread pushing device 4 includes a mounting body 41, a power source 42, a follower crank 43, a lower rotating element 44, a driving crank 45, an upper rotating element 46, an inclined coupler 47 and a needle-thread pushing member 48. The mounting body 41 is mounted fixedly on the machine frame 31. The follower crank 43 has an upper end that is mounted rotatably on the mounting body 41. The lower rotating element 44 is mounted rotatably on a lower end of the follower crank 43, and can rotate about a horizontal axis. The driving crank 45 has an upper end that is mounted rotatably on the mounting body 41, and can be driven by the power source 42. The upper rotating element 46 is mounted rotatably on a lower end of the driving crank 45, and can rotate about a horizontal axis. The coupler 47 extends through a hole 461 in the upper rotating element 46 and a hole 441 in the lower rotating element 44, and is locked on the upper and lower rotating elements 46, 44 by means of two lock bolts 462, 442. The needle-thread pushing member 48 is fixed on a lower end of the coupler 47.

Figure 4:
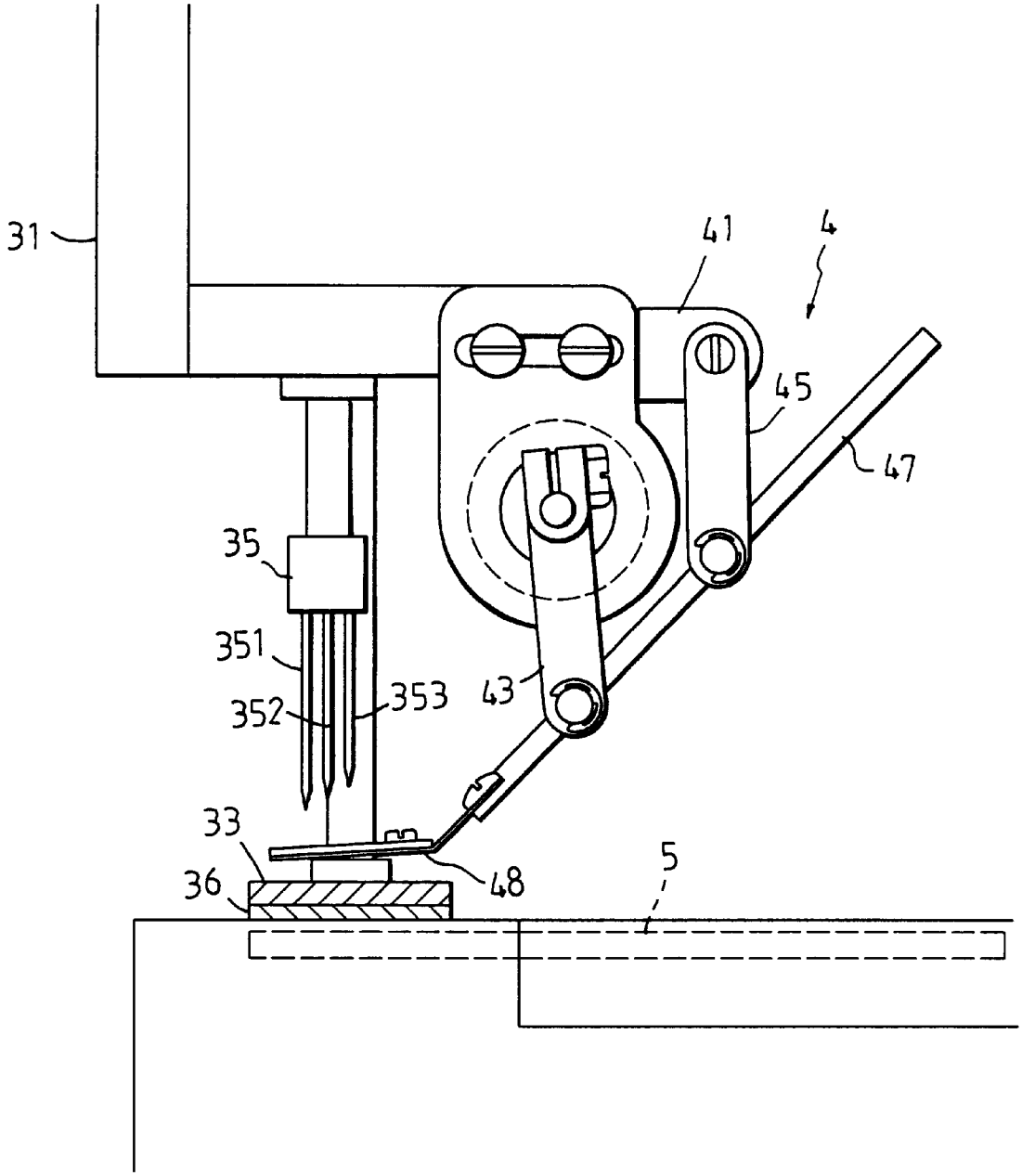
FIG. 4 is a schematic side view illustrating the thread pushing device of the preferred embodiment, in which the needle-thread pushing member is at a lower limit position.

As such, a linkage is constituted by the mounting body 41, the driving crank 45, the follower crank 43 and the coupler 47. The power source 42 drives the linkage to move the needle-thread pushing member 48 gradually forward and downward from an upper limit position shown in FIG. 3 to a lower limit position shown in FIG. 4 along a curved path between the presser foot 33 and the needles 351, 352, 353. In this way, needle threads, which are suspended from the needles 351, 352, 353, can be pushed away from the presser foot 33 by the needle-thread pushing member 48 just before the presser foot 33 moves downward toward the fabric 36.

Figure 5:
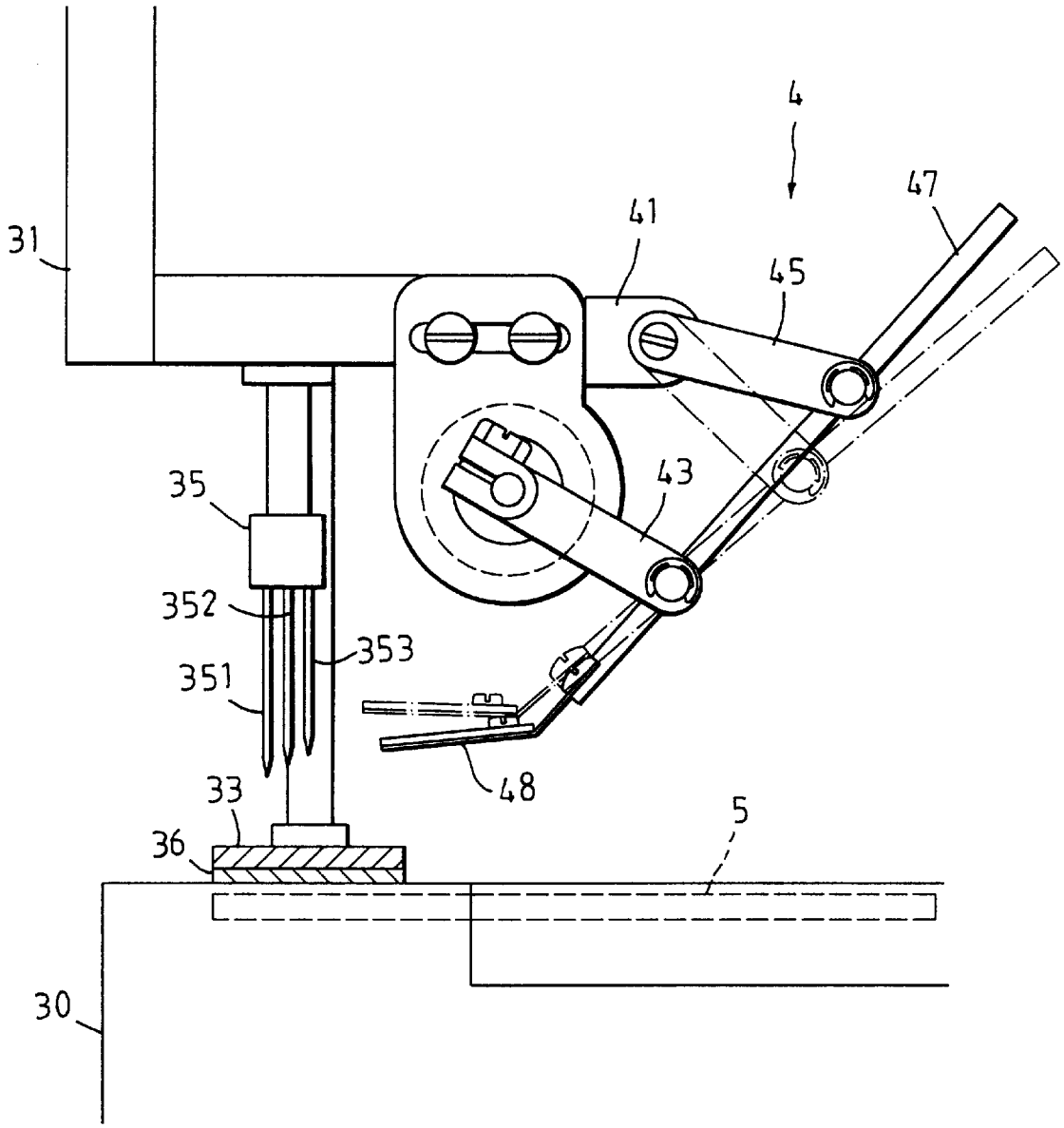
FIG. 5 is a schematic side view illustrating how the position of the needle-pushing member of the preferred embodiment is adjusted.

Referring to FIG. 5, when the thickness of the fabric 36 or the lengths of the needles 351, 352, 353 are changed, it is necessary to adjust the position of the needle-thread pushing member 48 relative to the machine bed 30. In this case, by loosening the lock bolt 462 (see FIG. 2), the upper rotating element 46 can be moved from the position shown by the solid lines to that shown by the phantom lines. Accordingly, the position of the needle-thread pushing member 48 relative to the machine bed 30 can be adjusted easily.

Figure 6:
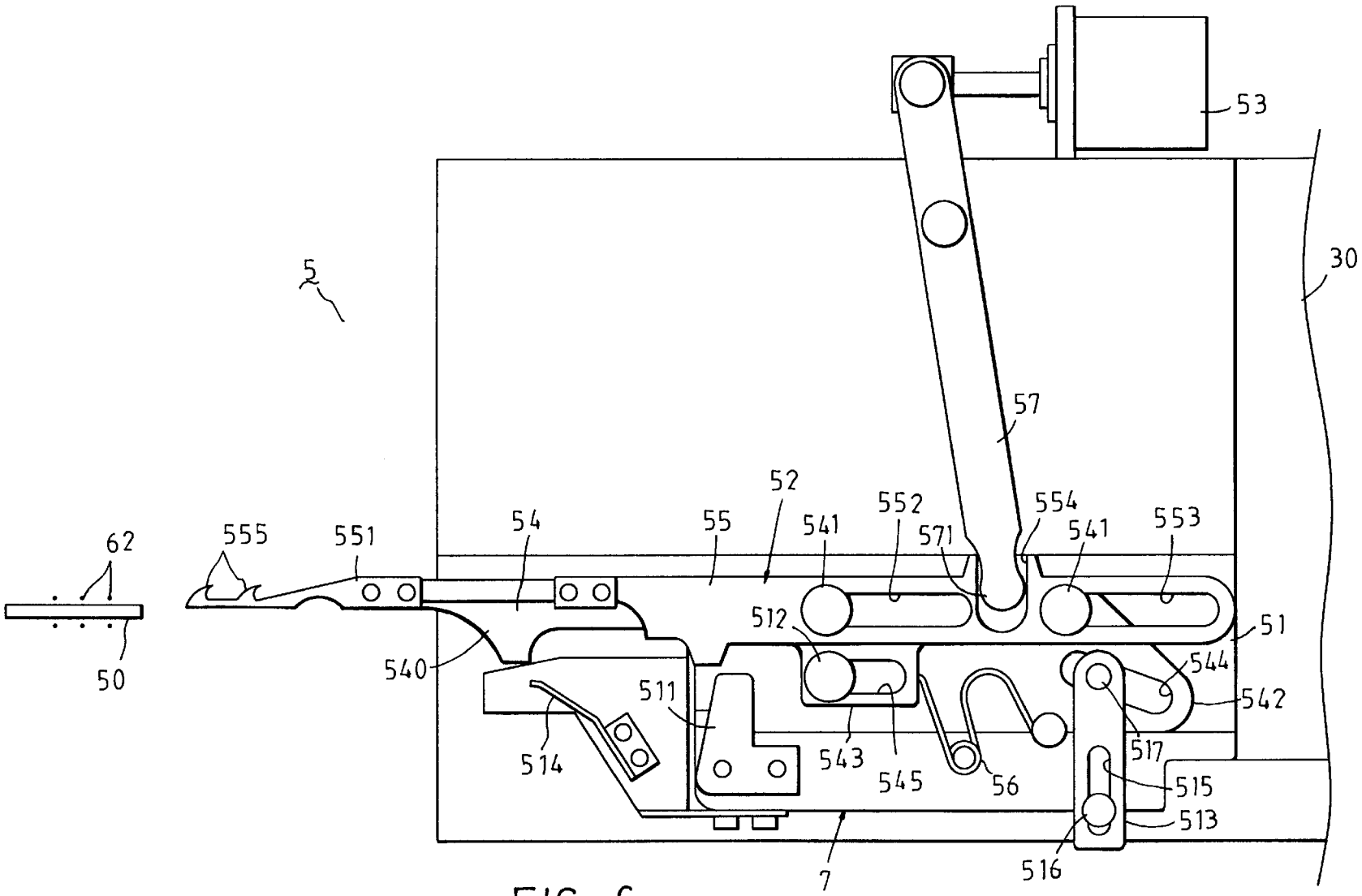
FIG. 6 is a schematic top view of a thread cutting device of the preferred embodiment, in which a cutter is at a rear limit position.

Referring to FIG. 6, the thread cutting device 5 is adapted to cut a horizontal row of looper threads 62, after a stitching action has been finished, and includes a horizontal thread-engaging needle 50, a horizontal base plate 51 and a movable assembly 52. The thread-engaging needle 50 is disposed in front of the movable assembly 52.

The base plate 51 includes a fixed stop member 511, a fixed sliding member 512, a horizontal adjustment rod 513, a reed spring 514, a longitudinal slide slot 515 formed in the adjustment rod 513, and a lock bolt 516 that extends through the longitudinal slide slot 515 for locking the adjustment rod 513 on the base plate 51.

The movable assembly 52 includes an elongated horizontal feed plate 54 mounted slidably on a top surface of the base plate 51 in a known manner, and an elongated horizontal cutting plate 55 in frictional contact with a top surface of the feed plate 54. As such, the feed plate 54 can slide with the cutting plate 55 on the base plate 51.

The feed plate 54 has a transversely extending front projection 540, two fixed sliding members 541, a transversely extending rear projection 542, a transversely extending middle projection 543, an inclined slide slot 544 formed in the rear projection 542, and a longitudinal slide slot 545 that is formed in the middle projection 543 and that extends along the length of the feed plate 54. The middle projection 543 is located behind the front projection 540, and is in front of the rear projection 542. The sliding member 512 of the base plate 51 is received slidably within the longitudinal slide slot 545 in the feed plate 54. A fixed vertical pin 517 of the adjustment rod 513 is received slidably within the inclined slide slot 544 in the feed plate 54.

The cutting plate 55 has a fixed cutter 551, a front longitudinal slide slot 552, a rear longitudinal slide slot 553 and an open-ended transverse slide slot 554. The sliding members 541 of the feed plate 54 are received respectively and slidably within the front and rear longitudinal slide slots 552, 553 in the cutting plate 55.

A torsion spring 56 interconnects the base plate 51 and the middle projection 543 of the feed plate 54 for pushing the feed plate 54 forward on the base plate 51.

A driving rod 57 is mounted pivotally on the base plate 51, and has a rounded end 571 that is received slidably within the transverse slide slot 554 in the cutting plate 55. A driving unit 53 can drive the driving rod 57 to swing about a vertical axis in a known manner so as to reciprocate the cutting plate 55 and the feed plate 54 on the base plate 51, thereby moving the feed plate 54 and the cutting plate 55 toward and away from the thread-engaging needle 50. Accordingly, the cutter 551 can move between a rear limit position shown in FIG. 6 and a front limit position shown in FIG. 7. When the cutter 551 is at the rear limit position, the sliding members 541 of the feed plate 54 are located at the front ends of the front and rear longitudinal slide slots 552, 553 in the cutting plate 55. When the cutter 551 is at the front limit position, the sliding members 541 of the feed plate 54 are located at the rear ends of the front and rear longitudinal slide slots 552, 553 in the cutting plate 55.

Figure 7:
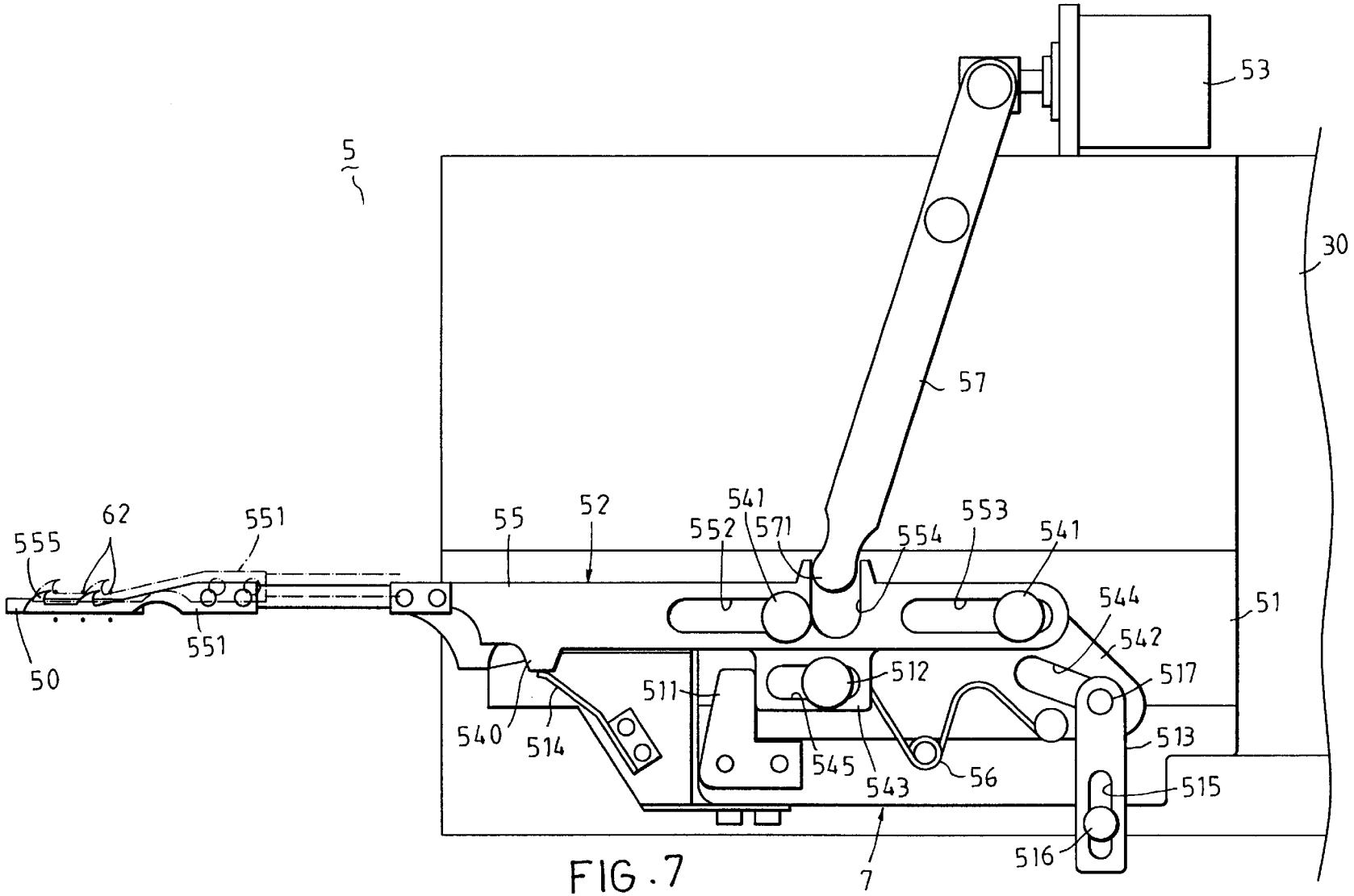
FIG. 7 is a schematic top view of the thread cutting device of the preferred embodiment, in which the cutter is at a front limit position.
Figure 8:
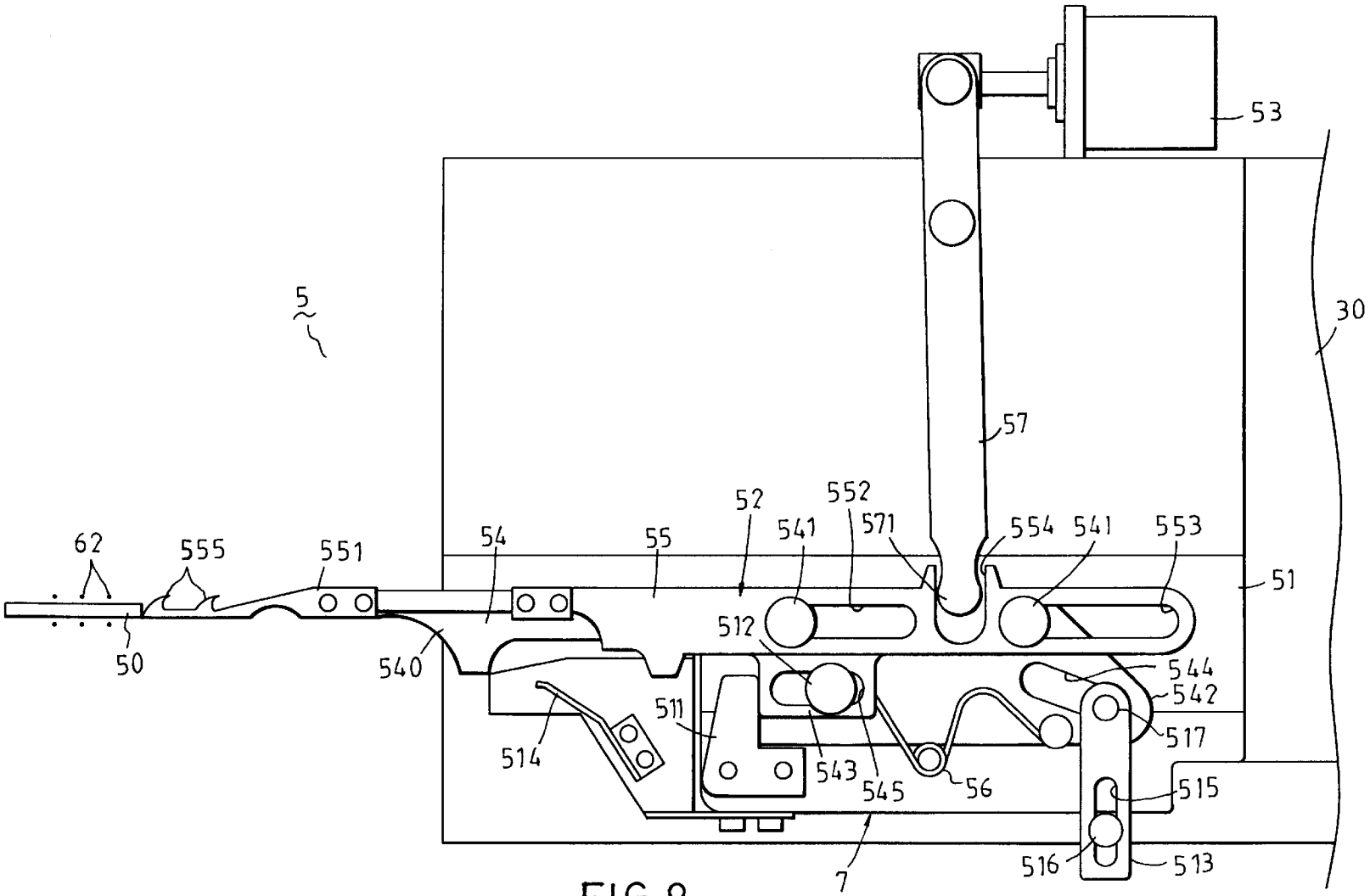
FIG. 8 is a schematic top view of the thread cutting device of the preferred embodiment, in which the cutter is at a stand-by position.

During forward movement of the feed plate 54 and the cutting plate 55, the cutter 551 can move from the rear limit position shown in FIG. 7 to a stand-by position shown in FIG. 8 along a curved path with the assistance of the torsion spring 56.

As shown in FIG. 8, when the cutter 43 is at the stand-by position, the middle projection 543 of the feed plate 54 contacts the stop member 511 of the base plate 51, thereby preventing further forward movement of the feed plate 54 on the base plate 51. In addition, the front end of the cutter 551 engages an end of the thread-engaging needle 50. In this case, the cutter 551 is aligned with and is located immediately over the thread-engaging needle 50, and two bladed barbs 555 of the cutter 551 are aligned with a row of three looper threads 62 to be cut, which are located on one side of the thread-engaging needle 50. When the rounded end 571 of the driving rod 57 continues to push the cutting plate 55 forward, the cutting plate 55 moves forward relative to the feed plate 54. As such, the cutter 551 moves over the thread-engaging needle 50 to the front limit position in a direction parallel to the thread-engaging needle 50.

Referring to FIG. 7, when cutter 551 moves rearward from the front limit position, the reed spring 514 pushes the bladed barbs 555 of the cutter 551 transversely from the position shown by the solid lines to that shown by the phantom lines, thereby engaging and cutting all of the three threads 62 in sequence.

After repair or maintenance of the movable assembly 52, to place all the elements of the assembly 52 in their correct positions, the middle projection 543 is brought first into contact with the stop member 511 of the base plate 51. Then, the front end of the cutter 551 is moved to engage the end of the thread-engaging needle 50 by adjusting the position of the adjustment rod 513 in a direction generally transverse to the length of the cutting plate 55.

With this invention thus explained, it is apparent that numerous modifications and variations can be made without departing from the spirit and scope of this invention. It is therefore intended that this invention be limited only as indicated by the appended claims.

I claim:

1. A sewing machine comprising:

a machine bed;

a presser foot disposed vertically and movably on said machine bed;

a needle seat disposed vertically and movably on said machine bed and located over said pressure foot;

a row of vertical stitching needles of different lengths mounted fixedly on said needle seat and arranged one behind another, a front one of each adjacent pair of said stitching needles having a lower end, which is located below that of the rear one;

a power source disposed on said machine bed;

a thread pushing device disposed on said machine bed behind said needle seat and including a needle-thread pushing member that is adapted to move gradually forward and downward between said presser foot and said stitching needles along a curved path so as to be adapted to push suspended needle threads away from said presser foot just before said presser foot moves downward toward a fabric to be stitched on said machine bed; and a thread cutting device adapted to cut a horizontal row of looper threads, after a stitching action has been finished, a linkage, which includes:

a driving crank mounted rotatably on said machine bed and swung by said power source;

a follower crank mounted rotatably on said machine bed; and an inclined coupler connected Pivotally to said driving crank and said follower crank and having a lower end that is connected fixedly to said needle-thread pushing member;

whereby, said power source can drive said linkage to move said needle-thread pushing member along the curved path, two rotating elements mounted respectively and rotatably on said driving crank and said follower crank, each of said rotating elements rotating about a horizontal axis and having a hole, through which said coupler extends slidably; and two lock bolts for locking said coupler respectively and releasably on said rotating elements;

whereby, the position of either of said rotating elements relative to said coupler can be varied by loosening said lock bolts to move said needle-thread pushing member on said machine bed.

2. A sewing machine as claimed in claim 1, wherein said thread cutting device includes:

a horizontal thread-engaging needle disposed in front of said thread cutting device and adapted for placement of the looper threads on one side of said thread-engaging needle;

a horizontal base plate having a fixed stop member and a fixed sliding member;

an elongated horizontal feed plate mounted slidably on a top surface of said base plate and formed with a fixed sliding member, a transversely extending middle projection, an inclined slide slot formed through a rear end portion of said feed plate, and a longitudinal slide slot that is formed through said feed plate and that is in front of said inclined slide slot, said fixed sliding member of said base plate being received slidably within said longitudinal slide slot in said feed plate;

an elongated horizontal cutting plate in frictional contact with a top surface of said feed plate, thereby permitting sliding movement of said cutting plate with said feed plate on said base plate, said cutting plate and said feed plate being mounted on said base plate such that said cutting plate and said feed plate are able to reciprocate on said base plate, said cutting plate having a longitudinal slide slot that receives slidably said sliding member therein, and an open-ended transverse slide slot, said longitudinal slide slot extending in a direction generally perpendicular to that of said transverse slide slot and being adapted to be disposed generally parallel to said thread-engaging needle, said cutting plate further including a fixed and elongated cutter at a front end thereof, said cutter being adapted to be disposed generally parallel to said thread-engaging needle and having a bladed barb, which is adapted to cut the looper threads during rearward movement thereof on said base plate;

a driving rod mounted pivotally on said base plate and having a rounded end, which is received slidably within said transverse slide slot in said cutting plate, said driving rod being capable of rotating about a vertical axis so that swinging movement of said driving rod results in reciprocating movement of said cutting plate and said feed plate on said base plate, thereby moving said cutting plate and said feed plate toward and away from said thread-engaging needle;

a driving unit for activating said driving rod to swing on said base plate about a vertical axis, thereby moving said cutter toward and away from the thread-engaging needle between a front limit position and a rear limit position when said driving unit is activated, said middle projection of said feed plate being capable of contacting said stop member of said base plate during forward movement of said cutting plate and said feed plate toward the thread-engaging needle, thereby preventing further forward movement of said feed plate on said base plate, so as to permit sliding movement of said sliding member within said longitudinal slide slot in said cutting plate, engagement of said middle projection of said feed plate with said stop member of said base plate locating said cutter at a stand-by position in which said cutter is adapted to be aligned with and located immediately above the thread-engaging needle and in which said bladed barb of said cutter is adapted to be aligned with the looper threads while a front end of said cutter engages an end of said thread-engaging needle, thereby permitting sliding movement of said cutting plate relative to said feed plate and over the thread-engaging needle along a straight path during subsequent swinging movement of said driving rod;

a horizontal adjustment rod adapted to be disposed generally parallel to said thread-engaging needle and having a fixed vertical pin, which is received slidably within said inclined slide slot, and a longitudinal slide slot, which is formed therethrough and which is adapted to be disposed generally perpendicular to said thread-engaging needle; and a lock bolt extending through said slide slot in said adjustment rod to lock said adjustment rod on said base plate and being capable of being loosened from said adjustment rod, thereby permitting movement of said adjustment rod on said base plate, whereby, in a situation where said cutter cannot be moved to said stand-by position, when said middle projection of said feed plate is moved to contact said stop member of said base plate, said adjustment rod can be moved in a direction generally transverse to said cutting plate on said base plate by operating said lock bolt so as to move said cutter to said stand-by position for performing a looper-thread cutting action.

* * * * *